US007748834B2

(12) United States Patent
Hamano

(10) Patent No.: US 7,748,834 B2
(45) Date of Patent: Jul. 6, 2010

(54) INK CARTRIDGE AND RECORDING APPARATUS

(75) Inventor: Yuichiro Hamano, Chiba (JP)

(73) Assignee: Seiko I Infotech Inc. (JP)

( * ) Notice: Subject to any disclaimer, the term of this patent is extended or adjusted under 35 U.S.C. 154(b) by 771 days.

(21) Appl. No.: 11/715,683

(22) Filed: Mar. 8, 2007

(65) Prior Publication Data

US 2007/0285482 A1 Dec. 13, 2007

(30) Foreign Application Priority Data

Mar. 30, 2006 (JP) ..... 2006-093691

(51) Int. Cl.
*B41J 2/175* (2006.01)
*B41J 2/195* (2006.01)

(52) U.S. Cl. ..... 347/86; 347/7

(58) Field of Classification Search ..... 347/7, 347/19, 86

See application file for complete search history.

(56) References Cited

U.S. PATENT DOCUMENTS 4,604,633 A * 8/1986 Kimura et al. ..... 347/7
5,754,207 A 5/1998 Gragg et al.
5,923,353 A 7/1999 Boyd et al.
6,312,084 B1 11/2001 Ujita et al.

FOREIGN PATENT DOCUMENTS

JP 58-211482 12/1983
JP 60-172546 9/1985

* cited by examiner

*Primary Examiner*—Stephen D Meier
*Assistant Examiner*—Geoffrey Mruk
(74) *Attorney, Agent, or Firm*—Adams & Wilks

(57) ABSTRACT

An ink cartridge has a flexible ink bag accommodated in a casing. A plate fixed to the ink bag moves together with deflation of the ink bag as the ink is consumed. A pin attached to the plate slides in a groove formed in a lever pivotally connected to the casing. A reflecting plate inside the casing reflects detection light projected from the outside through an opening in the casing to indicate that ink remains in the ink bag. As the ink nears complete consumption, the lever pivots to a position blocking the detection light from the reflecting plate thereby indicating that the ink has been used up.

8 Claims, 6 Drawing Sheets

INK CARTRIDGE AND RECORDING APPARATUS

BACKGROUND OF THE INVENTION

1. Field of the Invention

The present invention relates to an ink cartridge for use in an ink jet recording apparatus for recording images, characters, and the like on a recording sheet by ejecting ink droplets from a nozzle, and to a recording apparatus including the ink cartridge.

2. Related Background Art

At present, there are provided many ink jet recording apparatuses (ink jet printers) for recording images, characters, and the like by ejecting ink droplets on a medium on which recording is effected, such as a recording sheet. In the ink jet printer, ink is supplied to a recording head through an ink supply pipe, and ink droplets are ejected from a nozzle of the recording head onto a recording sheet, thereby performing recording.

Further, in an ink cartridge generally used for an ink jet printer, an ink bag in which ink is sealed in advance is accommodated in a casing. The ink bag has flexibility, so according to an ink residual amount, a thickness thereof changes. By measuring the thickness of the ink bag, the ink residual amount is estimated. This is because the ink residual amount cannot be directly determined.

As a method for measuring the thickness of the ink bag, there are provided various methods. There is generally known a method, in which a plate is attached onto an upper surface of the ink bag, and a change in thickness of the ink bag is detected as a vertical displacement of the plate. According to the method, by detecting the displacement of the plate, the ink residual amount can be determined. Thus, by detecting a state where the plate arrives at a position corresponding to the ink residual amount of "zero", it is possible to detect a state where the ink is used up.

However, for the recent ink bags, in order to ensure gas barrier property, an aluminum laminate film or the like is used as a material, and ink bags having higher rigidity of the ink back themselves come into use. Therefore, it is becoming difficult for the ink bags to smoothly deform according to the ink residual amount. Thus, it is difficult to detect the ink residual amount with a high degree of precision. In particular, the less the ink residual amount, the more conspicuous the deterioration in detection accuracy.

In this connection, there is known an ink cartridge capable of detecting the ink residual amount without being affected by the rigidity of the ink bag, for example, Japanese Patent No. 3141894.

In the ink cartridge, the ink bag is mounted so that the ink bag is not laid horizontally but faces sideways, that is, the plate fixed to the upper surface of the ink bag faces a vertical direction. Further, the plate is provided with a detection protrusion formed thereon for causing an external detection device to operate. The detection protrusion is formed so as to be positioned on a lower side of the ink bag when the ink cartridge is mounted. When the ink residual amount decreases, the detection protrusion protrudes to the outside from a window formed in the casing. Further, the detection protrusion which protrudes reaches an ink end detector (detection device) provided in an outside of the casing. When reached by the detection protrusion, the ink end detector detects a state where the ink is used up.

In particular, the ink bag is mounted so as to face sideways, so when consumption of the ink in the ink bag is started, the residual ink starts to gather in a lower portion of the ink bag due to the gravity. Note that in an initial state, the plate is inclined obliquely. When the ink gathering in the lower portion of the ink bag further flows out due to further ink consumption, the lower portion side starts to be crushed, so the plate moves so as to rotate about an upper portion of the ink bag as a center. As a result, the detection protrusion formed on the lower portion side of the ink bag moves toward the window of the casing to protrude to the outside of the casing. When the detection protrusion reaches the ink end detector, the detection of the ink residual amount is performed.

As described above, by moving the ink remaining in the ink bag to the lower portion side of the ink bag and rotating the plate, it is possible to displace the plate accurately according to the ink residual amount. Accordingly, even when the slightly rigid ink bag is used, it is possible to detect the ink residual amount without being affected by the rigidity. In particular, even when the ink residual amount is small, it is possible to detect the ink residual amount with a high degree precision.

However, there remains the following problems with the conventional ink cartridge.

That is, the conventional ink cartridge has such a structure that the ink residual amount is detected in response to arrival of the detection protrusion formed on the plate at the detector, so it is required to fix the plate accurately in a predetermined position on the ink bag. If a fixing position deviates from the predetermined position, there are possibilities that the detection protrusion does not protrudes from the window to the outside and that the detection protrusion reaches the ink end detector in advance while the ink bag is being deformed, thereby causing false detection.

In particular, the plate is adhered to be fixed to the ink bag by a double-sided adhesive tape or the like, so it is required to attach the plate while performing positioning carefully and accurately. Therefore, the attachment involves a great amount of time and effort. Further, even if the attachment operation is performed with care, the attachment accuracy involves no allowance, so there is a risk of the false detection being caused.

Further, the detection protrusion is formed on the plate fixed to the ink bag, so the detection protrusion moves in three dimensions in accordance with movement of the ink bag. Further, the ink bag does not move regularly every time, and is expected to move differently every time according to an installation state, frequency of use, or the like. Thus, a movement is not ensured in which the detection protrusion is allowed to protrude every time from the window according to the ink residual amount to be allowed to reach the ink end detector. In this point also, there is the possibility of causing the false detection.

SUMMARY OF THE INVENTION

The present invention has been made in view of the above-mentioned circumstances, and an object of the present invention is to provide an ink cartridge in which a regular movement is performed every time so that false detection of an ink residual amount is prevented, and the attachment accuracy thereof involves an allowance, thereby making it possible to easily perform an attachment operation.

The present invention provides the following means to solve the above-mentioned problems.

An ink cartridge according to the present invention is characterized by including: a flexible ink bag which has ink sealed in advance in an inside thereof and is changed in thickness according to an ink amount; a casing accommodating the ink bag; a plate, which is fixed to a surface of the ink bag and is capable of moving together with the ink bag, and has a pin protruding toward a side surface of the casing; a reflecting plate, which is provided in a position inwardly spaced a predetermined distance away from the side surface of the casing, for reflecting detection light entered from an outside of the casing; a lever portion, which is formed to extend in one direction from a base end side toward a tip side, the base end side being rotatably attached to the side surface so that the lever portion slides on the side surface of the casing, and which has on a side of the side surface a nonreflecting plate for preventing reflection of the detection light; and a guide groove having a long hole shape, which is formed from the tip side toward the base end side of the lever portion in a size allowing insertion of a tip of the pin, and by which the pin is guided as the plate moves, the ink cartridge being characterized in that the lever portion rotates when the plate moves due to the insertion of the pin into the guide groove, and causes, when the ink is used up, the nonreflecting plate to be positioned between the side surface of the casing and the reflecting plate so that the reflection of the detection light is prevented.

In the ink cartridge according to the present invention, first, the ink bag having a surface on which the plate is fixed is accommodated in the casing. At this time, the ink bag is accommodated such that a back surface side thereof faces a bottom surface side of the casing. Further, the tip of the pin provided to the plate is inserted into the guide groove of the lever portion which is provided on the side surface of the casing so as to be rotatable. That is, the plate and the lever portion are mechanically combined with each other due to engagement between the pin and the guide groove.

Here, in a state where the ink bag is unused and is completely filled with the ink, the ink bag is bulged to the maximum degree, so the plate is spaced apart from the bottom surface of the casing to the maximum degree. The lever portion is supported by the pin in a stable manner through the guide groove in a state where the tip side thereof is spaced apart from the bottom surface of the casing to the maximum degree. Further, the detection light entered from the outside of the casing is applied and reflected by the reflecting plate provided in a position inwardly spaced a predetermined distance away from the side surface. When the reflected light is detected, it is determined that the ink still remains in the ink bag.

Next, when consumption of the ink is started from the above-mentioned state, according to the amount of the ink remaining in the inside, the ink bag gradually deforms and the thickness thereof starts to change. Thus, the plate fixed to the surface of the ink bag and the pin start to gradually move toward the bottom surface of the casing. Then, the lever portion starts to rotate on the base end side as the center by being pulled by the pin inserted into the guide groove. That is, the lever portion rotates so that the tip side of the lever portion gradually moves toward the bottom surface of the casing. At this time, the lever portion makes the sliding movement while sliding on the side surface of the casing. Further, while the pin moves toward the bottom surface of the casing, the lever portion rotates on the base end side as the center, so the pin moves toward the tip side toward the base end side of the lever portion while being guided by the guide groove. Thus, the lever portion rotates following the movement of the pin smoothly.

When the ink is further consumed and the ink in the ink bag is used up, the ink bag deflates to the maximum degree, so the plate and the pin are near the bottom surface of the casing to the maximum degree. Thus, the tip side of the lever portion is also near the bottom-surface to the maximum degree, and the rotation stops. At this time the nonreflecting plate of the lever portion provided so as to oppose the side surface side of the casing is positioned between the side surface of the casing and the reflecting plate, so the nonreflecting plate blocks the detection light from being applied on the reflecting plate and prevents the reflection of the detection light. Thus, the reflected light cannot be detected, thereby making it possible to detect that the ink in the ink bag is used up.

In particular, the displacement of the ink bag can be converted into a rotational movement of the lever portion, which slides on the side surface of the casing, through the plate and the pin, that is, a linear movement in the thickness direction of the ink bag. Thus, even when the ink bag makes an irregular movement in three dimensions, the lever itself makes the sliding movement while certainly sliding on the side surface. Thus, the lever portion can be certainly moved in a regular manner every time and the nonreflecting plate can be reliably moved to a position between the side surface and the reflecting plate. That is, the lever portion only makes the sliding movement on the side surface. Therefore, it is possible to reliably perform positioning of the nonreflecting plate without the fear of contacting the reflecting plate to prevent reflection of the detection light. Accordingly, the false detection of the ink residual amount can be prevented.

Further, unlike the conventional one in which the detection protrusion is directly formed on the plate, the plate and the lever portion are mechanically combined with each other through the engagement between the pin and the guide groove, so there can be provided a small engagement tolerance (allowance) between the pin and the guide groove. Thus, even if slight positional shift in attachment occurs when the plate is fixed to the ink bag, the positional shift can be corrected (error in attachment position can be absorbed) by the engagement tolerance between the pin and the guide groove. Thus, as compared to the prior art, the attachment operation is facilitated, and it takes no trouble.

As described above, according to the ink cartridge of the present invention, it is possible to prevent the false detection of the ink residual amount by making a regular movement every time and easily perform the attachment operation because the attachment accuracy involves the allowance.

Further, an ink cartridge according to the present invention is characterized in that, in the above-mentioned ink cartridge of the present invention, the casing is provided with a guide member for guiding a rotational movement of the lever portion.

In the ink cartridge according to the present invention, the guide member is provided to the casing, so the lever portion rotates in a more stable state to make the sliding movement on the side surface of the casing. Thus, the false detection of the ink residual amount can be prevented more reliably.

Further, an ink cartridge according to the present invention is characterized in that, in the above-mentioned ink cartridge of the present invention, the lever portion is detachably attached to the casing.

In the ink cartridge according to the present invention, the lever portion is detachable. Therefore, it is possible to replace only the lever portion according to frequency of use, aged deterioration, or the like. Thus, in a case where components other than the ink bag are reused, running cost can be suppressed, and the false detection can be prevented for a long period of time with minimum replacement of the components.

A recording apparatus according to the present invention is characterized by including: any one of the above-mentioned ink cartridges of the present invention; a detection portion, which applies detection light toward a reflecting plate and receives the detection light reflected by the reflecting plate, for detecting a residual amount of ink based on light reception results; a recording head for performing recording by ejecting ink droplets onto medium on which recording is effected; an ink supply pipe for supplying the ink from the ink cartridge to the recording head; a carriage portion accommodating the recording head, for causing the recording head to make a sliding movement on the medium on which recording is effected; and a conveying portion for the medium on which recording is effected, for conveying the medium on which recording is effected.

In the recording apparatus according to the present invention, the ink sealed in the ink bag of the ink cartridge is appropriately supplied to the recording head from the ink supply pipe. The recording head ejects ink droplets to perform recording on the medium on which recording is effected while being caused to make the sliding movement by the carriage portion on the medium on which recording is effected such as a recording sheet or the like conveyed by the conveying portion for the medium on which recording is effected. As a result, various characters, figures, and the like can be appropriately recorded on the medium on which recording is effected.

The detection portion detects the residual amount of the ink in the ink bag by receiving the detection light reflected by the reflecting light in the ink cartridge. That is, when the detection portion receives the detection light reflected by the reflecting plate, it is determined that there still remains ink. Here, if the nonreflecting plate provided to the lever portion of the ink cartridge prevents reflection of the detection light, the detection portion determines that the ink in the ink bag is used up.

In particular, there is provided the ink cartridge in which the false detection of the ink residual amount is prevented, so it is possible to accurately detect that the ink is used up. Therefore, the ink cartridge can be replaced in a state where the ink is used up without waste, thereby making it possible to suppress the running cost. Thus, the recording apparatus is easy-to-use for the user and is economical.

According to the ink cartridge of the present invention, the false detection of the ink residual amount can be prevented by making the regular movement every time, and the attachment operation can be easily performed because the attachment accuracy involves the allowance.

Further, according to the recording apparatus of the present invention, there is provided the ink cartridge in which the false detection of the ink residual amount is prevented. Therefore, the ink cartridge can be replaced in a state where the ink is used up without waste, thereby making it possible to suppress the running cost. Thus, the recording apparatus is easy-to-use for the user and is economical.

DETAILED DESCRIPTION OF THE PREFERRED EMBODIMENTS

Hereinafter, an embodiment of a recording apparatus and an ink cartridge according to the present invention will be described with reference to FIGS. 1 to 8.

Figure 1:
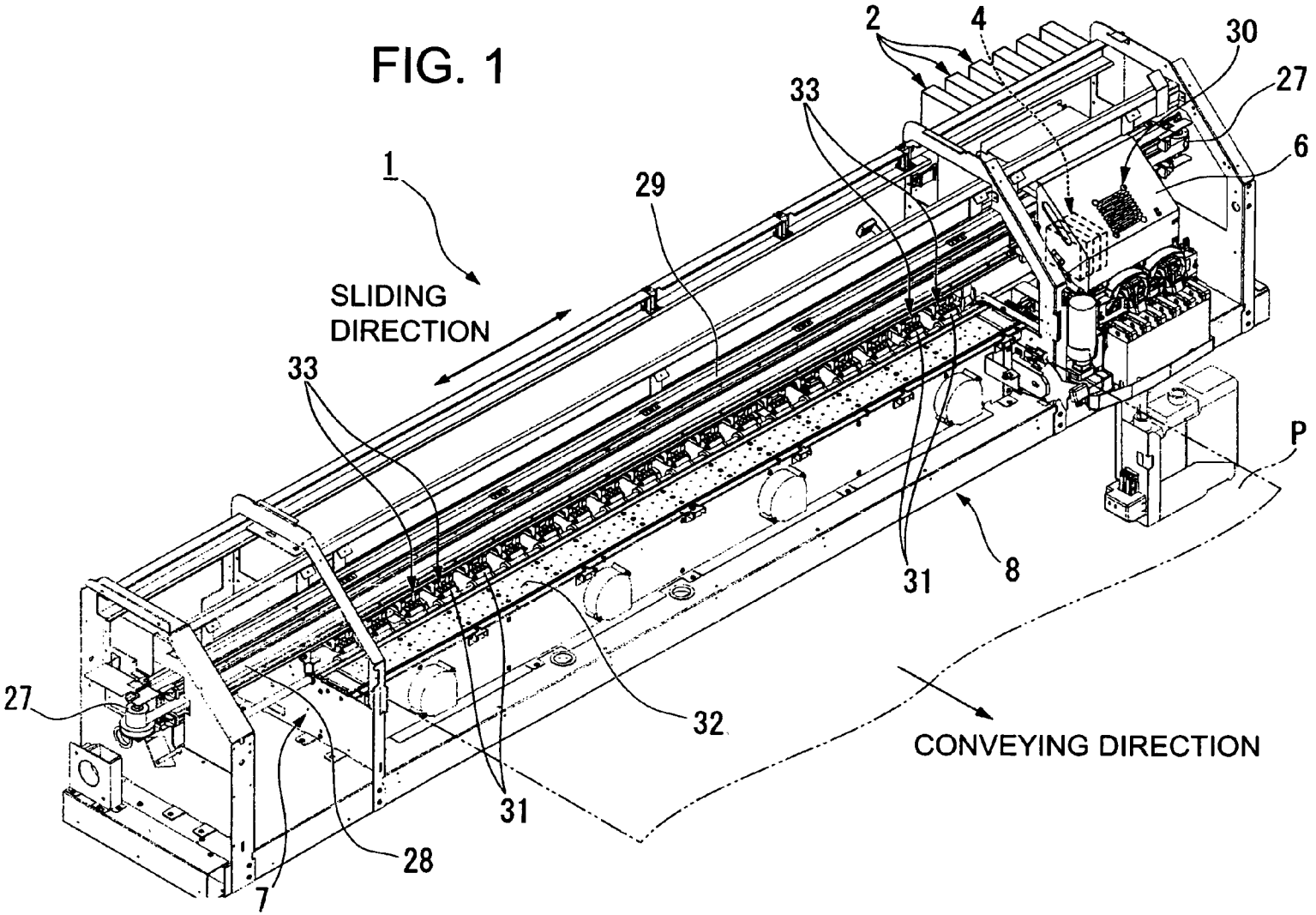
FIG. 1 is a perspective view of an ink jet printer according to the present invention.
Figure 2:
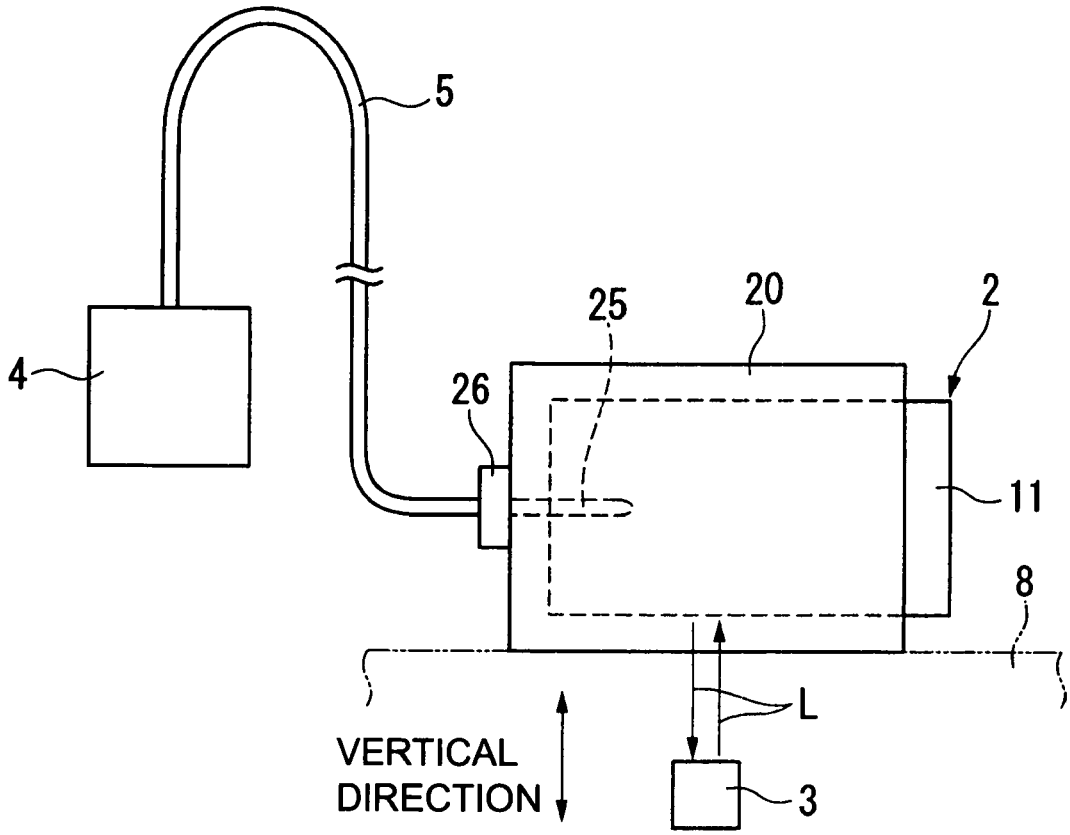
FIG. 2 is a view showing a mounting state of an ink cartridge constituting an ink jet printer of FIG. 1.

An ink jet printer (recording apparatus) 1 according to this embodiment includes, as shown in FIGS. 1 and 2, a plurality of ink cartridges 2 each containing ink of a different color, a detection portion 3, which applies a detection light L toward a reflecting plate 13 of the ink cartridge 2 and receives the detection light L reflected by the reflecting plate 13, for detecting a residual amount of an ink F based on light reception results, a recording head 4, which ejects ink droplets onto a recording sheet (medium on which recording is effected) P, for recording, an ink supply pipe 5 for supplying an ink F from the ink cartridge 2 to the recording head 4, a carriage portion 6 which accommodates the recording head 4 and is caused to make a sliding movement on the recording sheet P, a recording sheet conveying mechanism (conveying portion for the medium on which recording is effected) 7 for conveying the recording sheet P, and a base 8 on which the above-mentioned components are installed.

Figure 3:
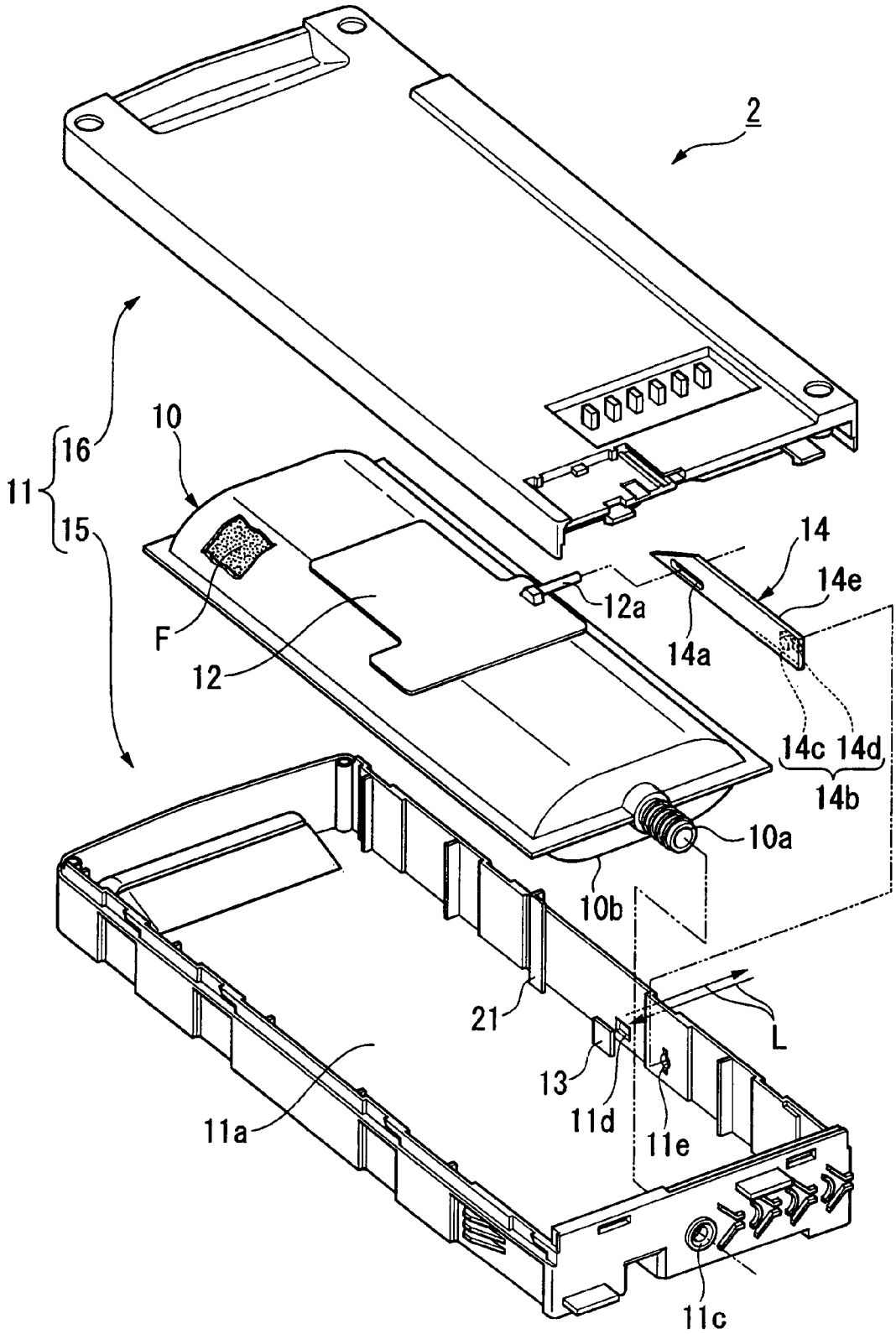
FIG. 3 is an exploded perspective view of the ink cartridge of FIG. 2.
Figure 4:
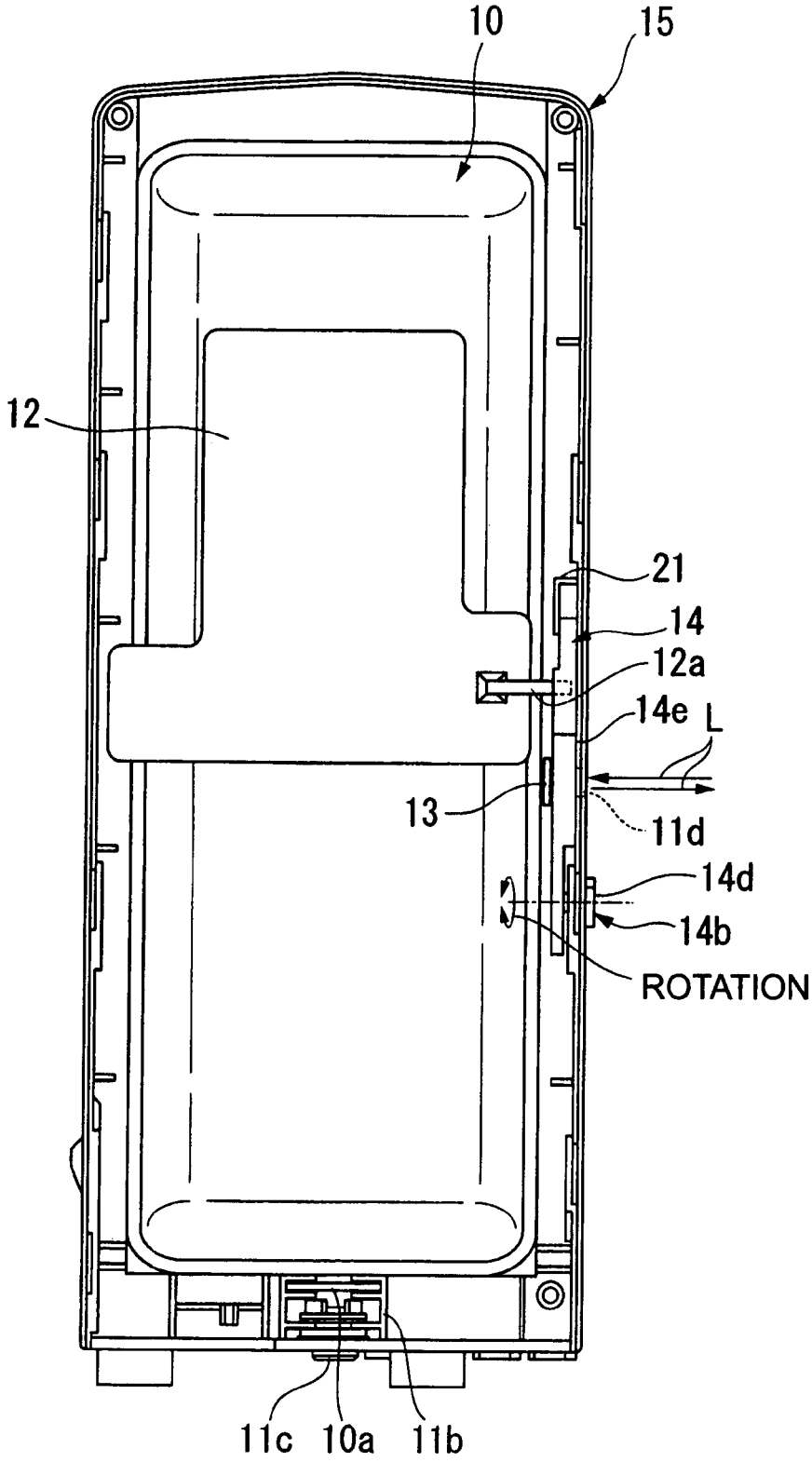
FIG. 4 is a top view of a state where a pouch of FIG. 3 is attached to a case main body.

The ink cartridge 2 includes, as shown in FIGS. 3 and 4, a flexible pouch (ink bag) 10 which has the ink F sealed in advance in an inside thereof and is changed in thickness according to an ink amount, a case (casing) 11 accommodating the pouch 10, a plate 12, which is fixed to a surface of the pouch 10 and is capable of moving together with the pouch 10, and has a pin 12*a* protruding toward a side surface of the case 11, the reflecting plate 13, which is provided in a position inwardly spaced a predetermined distance away from the side surface of the case 11, for reflecting the detection light L entered from an outside of the case 11, a lever portion 14, which is formed so as to extend in one direction from a base end side toward a tip side, the base end side being rotatably attached to the side surface so as to slide on the side surface of the case 11, and which has on a side of the side surface a nonreflecting sheet (nonreflecting plate) 14*e* for preventing reflection of the detection light L, and a guide groove 14*a* having a long hole shape, which is formed from the tip side toward the base end side of the lever portion 14 in a size allowing insertion of a tip of the pin 12*a*, and by which the pin 12*a* is guided when the plate 12 moves.

The pouch 10 has a structure in which in order to improve gas barrier property, an aluminum foil is sandwiched between two overlapping films, for example, a nylon film on an outer side and an aluminum laminate film sandwiched by polyethylene films on an inner side, and peripheries of those are joined with each other by thermal welding or the like. To one end of the pouch 10, an ink take-out port 10*a* for discharging the ink F sealed in the inside to the outside is joined by the thermal welding or the like. The ink take-out port 10*a* is formed of plastic or the like in a pipe-like configuration, and a plurality of fixation grooves for attachment to the case 11 are formed in an outer peripheral surface thereof.

The pouch 10 constructed as described above, is fixed to a bottom surface 11*a* by adhesion or the like in a state where a back surface 10*b* faces a side of the bottom surface 11*a* of the case 11. At this time, in a state where the fixation grooves of the ink take-out port 10*a* engage with an engagement groove 11*b* provided to the case 11 and positioning is effected, fixation is reliably performed.

The plate 12 is formed of plastic or the like in a T shape as seen in a top view, and is fixed to a substantially middle position on a side of the surface of the pouch 10. The pin 12*a* is formed integrally with the plate 12 and has such a length that the tip of the pin 12*a* reaches the vicinity of the side surface of the case 11.

The case 11 is formed of plastic or the like in a box shape, and is composed of a case main body 15 and a cover portion 16 attached to each other with fastening members such as screws so as to be detachable from each other. In other words, the engagement groove 11*b* is provided in the bottom surface 11*a* of the case main body 15 so that the pouch 10 is fixed in position. Further, the case main body 15 is provided with, at a position opposing the ink take-out port 10*a* of the pouch 10, an insertion port 11*c* through which a supplying needle 25, which is described later, is inserted into the ink take-out port 10*a*.

The case 11 can be mounted in a holder 20 shown in FIG. 2 so as to be detachable while accommodating therein the pouch 10. At this time, the case 11 is mounted in the holder 20 fixed to the base 8, a side to which the lever portion 14 is attached being a lower side. That is, in this embodiment, the case 11 is mounted so as to face sideways so that the plate 12 faces a vertical direction.

Further, the reflecting plate 13 is formed, as shown in FIGS. 3 and 4, on the bottom surface 11*a* of the case main body 15, and on a surface thereof opposing the side surface of the case main body 15, a reflective sheet (not shown) is attached. In the side surface of the case main body 15 opposing the reflecting plate 13, there is formed an opening portion 11*d*. Through the opening portion 11*d*, the detection light L is entered from the outside. The detection portion 3 is provided below the holder 20 as shown in FIG. 2. When the case 11 is mounted in the holder 20, the detection portion 3 applies the detection light L from a position below the holder 20 toward the reflecting plate 13 through the opening portion 11*d*. Further, similarly, the detection light L reflected by the reflecting plate 13 is allowed to enter the detection portion 3 again through the opening portion 11*d*.

The lever portion 14 is formed, as shown in FIGS. 3 and 4, in a flat plate shape extending in one direction, and a protruding portion 14*b* is formed on the side surface on the base end side thereof. The protruding portion 14*b* is composed of a cylindrical shaft portion 14*c* and a flat plate portion 14*d* extending in the same direction as the lever portion 14. Note that the length of the shaft portion 14*c* is slightly longer than a thickness of the case main body 15, and a center of the shaft portion 14*c* serves as a rotation center of the lever 14*c*. At the tip of the lever portion 14, there is formed the guide groove 14*a* described above. Further, on a surface of the lever portion 14 opposing the side surface of the case main body 15, the above-mentioned nonreflecting sheet 14*e* is attached.

On the other hand, in the side surface of the case main body 15, a through hole 11*e* for causing the protruding portion 14*b* to pass therethrough is formed in the vicinity of the opening portion 11*d*. At this time, the through hole 11*e* is formed such that the flat plate portion 14*d* passes therethrough in a state where the flat plate portion 14*d* faces a thickness direction of the case main body 15 (vertical direction). That is, when the lever portion 14 is attached to the case main body 15, the protruding portion 14*b* can be inserted into the through hole 11*e* in a state where the lever portion 14 is upright. Further, after the insertion, by rotating the lever portion 14, the flat plate portion 14*d* abuts on the outer surface of the case main body 15, so the lever portion 14 does not fall off. In contrast, in detaching, the lever portion 14 is rotated to be upright, the protruding portion 14*b* can be drawn out from the inside of the through hole 11*e* to be detached.

With the use of engagement orientations of the protruding portion 14*b* and the through hole 11*e*, the lever portion 14 is made detachable with respect to the case main body 15.

The lever portion 14 attached to the side surface of the case main body 15 is mechanically combined with the plate 12 with the pin 12*a* being inserted into the guide groove 14*a*.

Further, on the bottom surface 11*a* of the case main body 15, there is provided an L angle (guide member) 21 for guiding a rotational movement of the lever portion 14 while coming into surface contact with the side surface on the tip side of the lever potion 14.

When the ink cartridge 2 constructed as described above is mounted in the holder 20 as shown in FIG. 2, the supplying needle 25 provided to the holder 20 passes through the ink take-out port 10*a* through the insertion port 11*c* to reach the inside of the ink F bag. The supplying needle 25 is connected to the ink supply pipe 5 through a filter 26 for filtering fine foreign matters in the ink F. The ink supply pipe 5 is formed of a flexible tube and is adjusted to have such a length that does not affect the recording head 4 which makes the sliding movement together with the carriage portion 6.

The carriage portion 6 is connected, as shown in FIG. 1, to a conveyor belt 28 wrapped around a pair of pulleys 27. The pair of pulleys 27 receives a torque from a motor (not shown) to be rotated. Further, the base 8 is provided with a guide rail 29 for guiding the sliding movement of the carriage portion 6. The guide rail 29 and the conveyor belt 28 are provided on the base 8 so as to extend in a direction perpendicular to a direction in which the recording sheet P is conveyed. Accordingly, the carriage portion 6 makes the sliding movement in the direction perpendicular to the conveying direction of the recording sheet P.

Note that, the above-mentioned recording head 4, the carriage portion 6, the conveyor belt 28, the pair of pulleys 27, the drive motor, and the guide rail 29 constitute a printing and recording mechanism 30.

The recording sheet conveying mechanism 7 includes conveyor rollers 31 for conveying the recording sheet P, a platen 32 for supporting the recording paper P, and pressing members 33 for pressing the recording paper P onto the conveyor rollers 31. The platen 32 is provided on the base 8 so as to extend in the same direction as the moving direction of the carriage portion 6, that is, the direction perpendicular to the direction in which the recording paper P is conveyed.

Next, descriptions will be made below of a case where the ink jet printer 1 structured as described above is used to record characters, figures, and the like on the recording sheet P.

Figure 5:
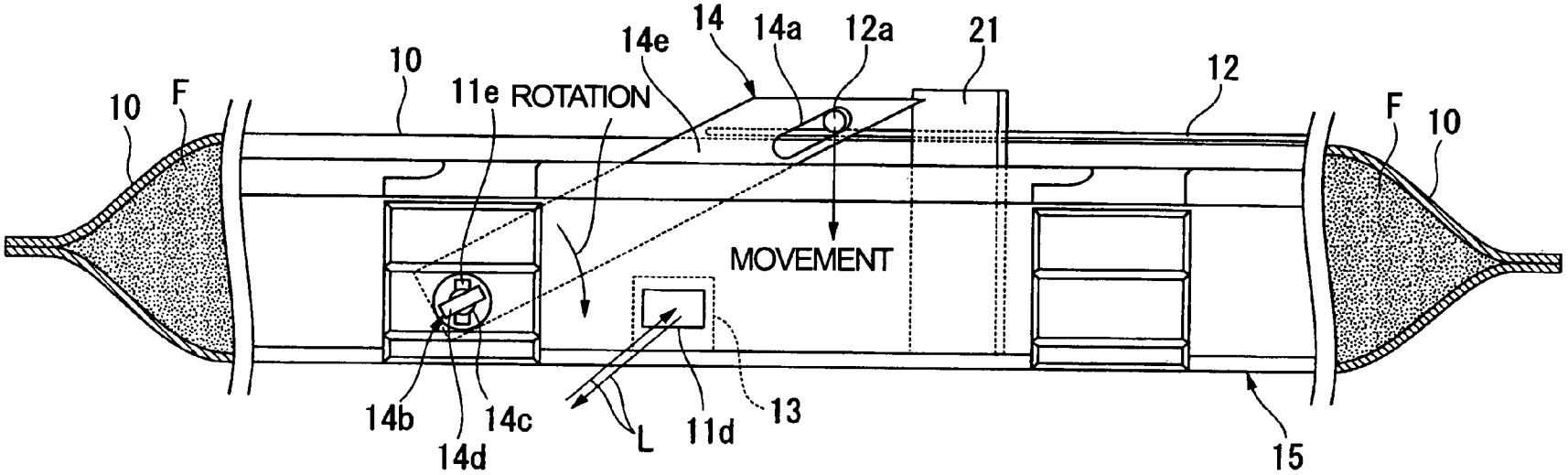
FIG. 5 is a side view of a state where an unused pouch is attached to the case main body.
Figure 6:
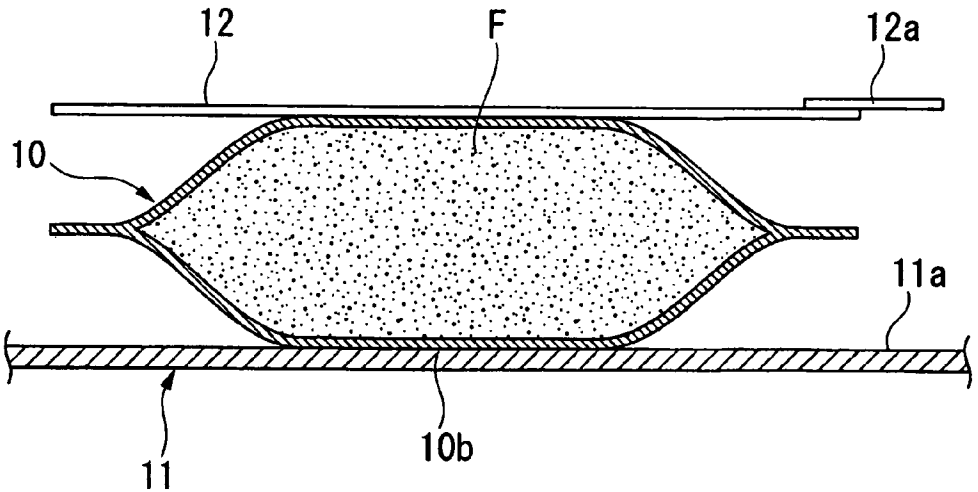
FIG. 6 is a sectional view of the pouch and the plate in a state of FIG. 5.

Note that the ink cartridge 2 which is set is unused and in which the pouch 10 is completely filled with the ink F. In other words, in the initial state, the pouch 10 is bulged to the maximum degree. Therefore, as shown in FIGS. 5 and 6, the plate 12 is spaced apart from the bottom surface 11*a* of the case main body 15 to the maximum degree. The lever portion 14 is supported by the pin 12*a* in a stable manner through the guide groove 14*a* in a state where the tip of the lever portion 14 is spaced apart from the bottom surface 11*a* of the case main body 15 to the maximum degree. Further, the detection light L applied by the detection portion 3 from a position below the case main body 15 passes through the opening portion 11*d* formed in the side surface of the case main body 15 and is applied and reflected by the reflecting plate 13. The detection portion 3 determines that the ink F still remains in the pouch 10 by receiving the reflected detection light L.

Next, when the ink jet printer 1 is operated, the ink F in the pouch 10 is supplied to the recording head 4 by the ink supply pipe 5 through the filter 26. At the same time, the carriage portion 6 accommodating the recording head 4 is caused to make the sliding movement by the conveyor belt 28 in the direction perpendicular to the conveying direction of the recording sheet P while being guided by the guide rail 29. The recording head 4 performs recording characters, figures, and the like by ejecting ink droplets onto the recording sheet P out of the supplied ink F while the carriage portion 6 is making the sliding movement. Further, the recording sheet conveying mechanism 7 conveys the recording sheet P little by little simultaneously with the recording.

As a result, various kinds of information can be appropriately recorded in predetermined positions on the recording sheet P.

When the recording is performed and the consumption of the ink F in the pouch 10 is started, the pouch 10 starts to deform and the thickness thereof starts to gradually change according to the amount of the ink remaining inside. Thus, both the plate 12 and the pin 12*a* fixed to the surface of the pouch 10 start to move gradually toward the bottom surface 11*a* of the case main body 15. The lever portion 14 starts to rotate about the shaft portion 14*c* on the base end side by being pulled by the pin 12*a* inserted in the guide groove 14*a*. That is, the lever portion 14 starts to rotate so that the tip side thereof moves toward the bottom surface 11*a* of the case main body 15. At this time, the lever portion 14 makes the sliding movement on the side surface of the case main body 15 while sliding thereon. Further, the pin 12*a* moves toward the bottom surface 11*a* of the case main body 15, while the lever portion 14 rotates about the base end side. Therefore, the pin 12*a* is moved from the tip side toward the base end side of the lever portion 14 while being guided by the guide groove 14*a*. Thus, the lever portion 14 rotates following the movement of the pin 12*a* smoothly.

Figure 7:
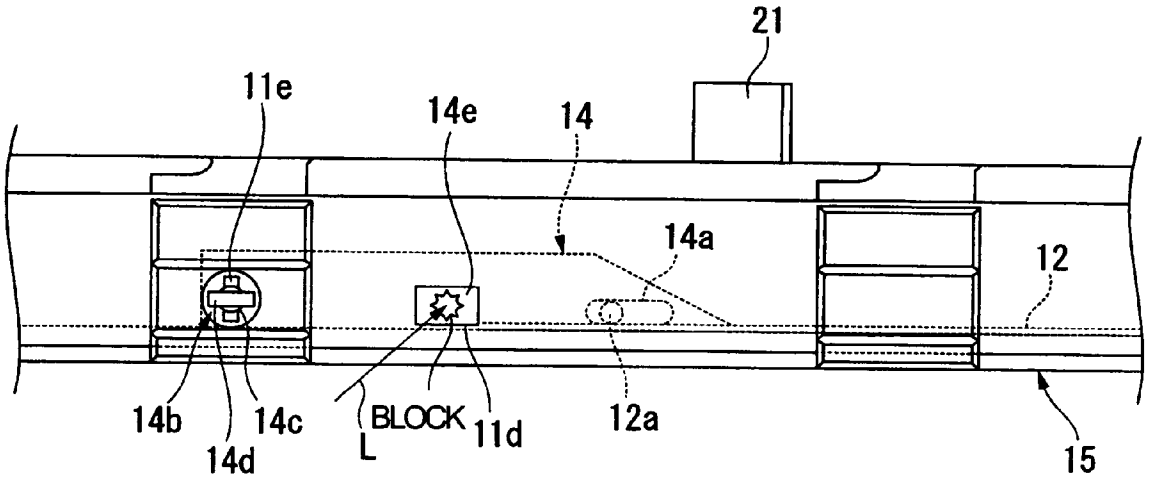
FIG. 7 is a view showing a state where the ink is consumed from the state of FIG. 5 to be used up.
Figure 8:
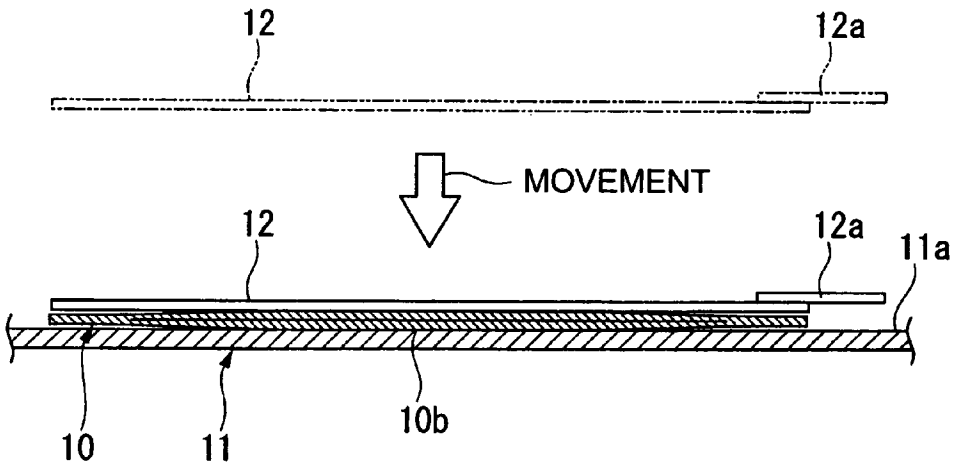
FIG. 8 is a sectional view of the pouch and the plate in a state of FIG. 7.

When the ink F is further consumed and the ink F in the pouch 10 is used up, as shown in FIGS. 7 and 8, the pouch 10 deflates to the maximum degree, so both the plate 12 and the pin 12*a* are near the bottom surface 11*a* of the case main body 15 to the maximum degree. Thus, similarly, the tip side of the lever portion 14 is near the bottom surface 11*a* of the case main body 15 to the maximum degree, and the rotation stops. In other words, the lever portion 14 extends along the bottom surface 11*a* of the case main body 15.

At this time, the nonreflecting sheet 14*e* of the lever portion 14 provided so as to oppose the side surface side of the case main body 15 is positioned between the side surface of the case main body 15 and the reflecting plate 13, and the nonreflecting sheet 14*e* blocks the detection light L from being applied on the reflecting plate 13 and prevents the reflection of the detection light L. Therefore, the detection portion 3 cannot receive the reflected light, so the detection portion 3 can detect that the ink F in the pouch 10 is used up (ink end).

In particular, in the ink cartridge 2 of this embodiment, the displacement of the pouch 10 is can be converted into the rotational movement of the lever portion 14 which slides on the side surface of the case main body 15 through the plate 12 and the pin 12*a*, that is, a linear movement in the thickness direction of the pouch 10. Thus, even when the pouch 10 moves irregularly in three dimensions, the lever 14 itself makes the sliding movement while certainly sliding on the side surface. Accordingly, it is possible to reliably move the lever portion 14 regularly every time, so the nonreflecting sheet 14*e* can be reliably moved to a portion between the side surface and the reflecting plate 13. That is, the lever portion 14 makes only the sliding movement on the side surface, so there is no fear of the lever portion 14 coming into contact with the reflecting plate 13, so positioning of the nonreflecting sheet 14*e* is reliably performed to prevent the reflection of the detection light L. Thus, the false detection of the residual amount of the ink F can be prevented. Further, a distance between the lever portion 14 and the detection portion 3 which is continuously invariant is linked to prevention of the false detection.

Further, unlike conventional one in which the protrusion is directly formed on the plate 12, the pin 12*a* and the guide groove 14*a* are engaged with each other, to thereby mechanically combine the plate 12 and the lever portion 14 to each other, so there can be provided a small engagement tolerance (allowance) between the pin 12*a* and the guide groove 14*a*. Thus, even if slight positional shift in attachment occurs when the plate 12 is fixed to the pouch 10, the positional shift can be corrected (attachment error can be absorbed) by the engagement tolerance between the pin 12*a* and the guide groove 14*a*. Thus, as compared to the prior art, the attachment operation is facilitated, and it takes no trouble.

Further, the case main body 15 is provided with the L angle 21, so the lever portion 14 makes the sliding movement on the side surface of the case main body 15 in a more stable manner. Thus, the false detection of the residual amount of the ink F can be prevented more reliably.

Further, the lever portion 14 can be detached from the case main body 15, so it is possible to replace only the lever portion 14 according to frequency of use, aged deterioration, or the like. Therefore, in a case where components other than the pouch 10 are reused, running cost can be suppressed, and the false detection can be prevented for a long period of time with minimum replacement of the components.

As described above, according to the ink cartridge 2 of this embodiment, it is possible to prevent the false detection of the residual amount of the ink F by making regular movement every time, and it is possible to easily perform the attachment operation because the attachment accuracy involves the allowance.

Further, in the ink jet printer 1 including the ink cartridge 2 having such an advantage, it is possible to accurately detect that the ink F is used up. Thus, the ink cartridge 2 can be replaced in a state where the ink F has been used up without waste, so the running cost can be suppressed. Accordingly, the ink jet printer 1 is easy-to-use for the user and is economical.

Note that, the technical scope of the present invention is not limited to the above-mentioned embodiment, and various modifications can be added without departing from the gist of the preset invention.

For example, in the above-mentioned embodiment, the ink cartridge is set to face sideways so that the plate faces the vertical direction, but this is not restrictive. For example, the ink cartridge may be set horizontally so that the plate faces the horizontal direction. In this case also, the same operational effect can be achieved.

What is claimed is:

1. An ink cartridge comprising:

a flexible ink bag which has ink sealed in advance in an inside thereof and is changed in thickness according to an amount of the ink;

a casing accommodating the ink bag;

a plate, which is fixed to a surface of the ink bag and is capable of moving together with the ink bag, and has a pin protruding toward a side surface of the casing;

a reflecting plate, which is provided in a position inwardly spaced a predetermined distance apart from the side surface of the casing, for reflecting detection light entered from an outside of the casing;

a lever portion, which is formed to extend in one direction from a base end side toward a tip side, the base end side being rotatably attached to the side surface so that the lever portion slides on the side surface of the casing, and which has on a side of the side surface a nonreflecting plate for preventing reflection of the detection light; and a guide groove having a long hole shape, which is formed from the tip side toward the base end side of the lever portion in a size allowing insertion of a tip of the pin, and by which the pin is guided when the plate moves, the ink cartridge being characterized in that the lever portion rotates when the plate moves due to the insertion of the pin into the guide groove, and causes, when the ink is used up, the nonreflecting plate to be positioned between the side surface of the casing and the reflecting plate so that the reflection of the detection light is prevented.

2. An ink cartridge according to claim 1, wherein the casing is provided with a guide member for guiding a rotational movement of the lever portion.

3. An ink cartridge according to claim 1, wherein the lever portion is detachably attached to the casing.

4. An ink cartridge according to claim 2, wherein the lever portion is detachably attached to the casing.

5. A recording apparatus comprising:

the ink cartridge according to claim 1;

a detection portion, which applies detection light toward a reflecting plate and receives the detection light reflected by the reflecting plate, for detecting a residual amount of ink based on light reception results;

a recording head for performing recording by ejecting ink droplets onto medium on which recording is effected;

an ink supply pipe for supplying the ink from the ink cartridge to the recording head;

a carriage portion accommodating the recording head, for causing the recording head to make a sliding movement on the medium on which recording is effected; and a conveying portion for the medium on which recording is effected, for conveying the medium on which recording is effected.

6. A recording apparatus comprising:

the ink cartridge according to claim 2;

a detection portion, which applies detection light toward a reflecting plate and receives the detection light reflected by the reflecting plate, for detecting a residual amount of ink based on light reception results;

a recording head for performing recording by ejecting ink droplets onto medium on which recording is effected;

an ink supply pipe for supplying the ink from the ink cartridge to the recording head;

a carriage portion accommodating the recording head, for causing the recording head to make a sliding movement on the medium on which recording is effected; and a conveying portion for the medium on which recording is effected, for conveying the medium on which recording is effected.

7. A recording apparatus comprising:

the ink cartridge according to claim 3;

a detection portion, which applies detection light toward a reflecting plate and receives the detection light reflected by the reflecting plate, for detecting a residual amount of ink based on light reception results;

a recording head for performing recording by ejecting ink droplets onto medium on which recording is effected;

an ink supply pipe for supplying the ink from the ink cartridge to the recording head;

a carriage portion accommodating the recording head, for causing the recording head to make a sliding movement on the medium on which recording is effected; and a conveying portion for the medium on which recording is effected, for conveying the medium on which recording is effected.

8. A recording apparatus comprising:

the ink cartridge according to claim 4;

a detection portion, which applies detection light toward a reflecting plate and receives the detection light reflected by the reflecting plate, for detecting a residual amount of ink based on light reception results;

a recording head for performing recording by ejecting ink droplets onto medium on which recording is effected;

an ink supply pipe for supplying the ink from the ink cartridge to the recording head;

a carriage portion accommodating the recording head, for causing the recording head to make a sliding movement on the medium on which recording is effected; and a conveying portion for the medium on which recording is effected, for conveying the medium on which recording is effected.

* * * * *